US005809990A

United States Patent [19]

Jones et al.

[11] Patent Number: 5,809,990

[45] Date of Patent: Sep. 22, 1998

[54] COOKING RANGE WITH AUTOMATIC GAS BURNER IGNITION

[75] Inventors: Richard R. Jones, St. Louis, Mo.; Dennis Munemitsu, N. Hollywood, Calif.

[73] Assignee: Rankin-Delux, Inc., Santa Fe Springs, Calif.

[21] Appl. No.: 712,883

[22] Filed: Sep. 12, 1996

[51] Int. Cl.[6] ..... F24C 3/00

[52] U.S. Cl. ..... 126/39 N; 126/39 R; 126/39 BA; 137/66

[58] Field of Search ..... 126/374, 373, 126/39 E, 39 R, 39 BA, 39 N; 251/25; 137/66

[56] References Cited

U.S. PATENT DOCUMENTS

| | | | |
|---|---|---|---|
| 2,402,997 | 7/1946 | Grayson | 126/374 |
| 2,678,991 | 5/1954 | Amfitheatrof | 126/374 |
| 2,926,656 | 3/1960 | Hale | 126/42 |
| 3,446,227 | 5/1969 | Grayson | 137/66 |
| 3,574,308 | 4/1971 | Battersby | 137/66 |
| 3,666,173 | 5/1972 | Ray | 137/66 X |
| 4,044,794 | 8/1977 | Matthews | 137/66 X |
| 4,681,084 | 7/1987 | Grech | 126/39 E |

*Primary Examiner*—Larry Jones
*Attorney, Agent, or Firm*—G. Donald Weber, Jr.

[57] ABSTRACT

A cooking range, especially useful in commercial environments, wherein an automatic ignition gas burner is mounted thereon. The range includes an input valve connected to a gas fired burner element. The valve is mechanically operated by a plunger which is selectively engaged by a utensil placed on the cooking range in a preferred embodiment. The plunger may be connected to the valve directly or by a mechanical linkage.

15 Claims, 2 Drawing Sheets

COOKING RANGE WITH AUTOMATIC GAS BURNER IGNITION

BACKGROUND

1. Field of the Invention

This invention relates, generally, to cooking ranges and, particularly, to an automatic ignition burner and valve for use with a cooking range or the like.

2. Prior Art

There are many cooking ranges known in the art. These ranges include electric and gas fired ranges. The ranges can be for domestic use, e.g. use in the home, or for commercial use, e.g. use in restaurants or the like.

In the case of commercial use, the ranges are usually gas fired for a number of reasons including easier and quicker temperature control. That is, the flame and, therefore, the temperature achieved can be adjusted virtually instantaneously with gas-fired ranges. Moreover, the adjustments of gas ranges can frequently be more finely controlled. Likewise, gas ranges which include pilot lights (or spark ignition) in conjunction with the gas burner include the advantage of "instant on" operation. That is, as soon as gas is suppied to the burner via the control valve, the flame is available for cooking.

Nevertheless, in many commercial establishments, e.g. restaurants, the cooks or chefs tend to leave the burners "on" during the cooking process, even though the cooking utensils have been removed from the burner. This has the disadvantages of using excessive fuel, presenting a safety hazard, and creating unnecessary heat conditions in the kitchen area. On the other hand, if the flame is extinguished each time the cooking utensil is removed from the burner, the gas control valve must be reset to the preferred position when the utensil is replaced. This causes a delay (albeit slight) in the cooking process. Also, it creates the possibility of lack of uniformity in the cooking techniques of the preparer.

SUMMARY OF THE INSTANT INVENTION

A cooking range, especially useful in commercial environments, wherein at least one gas burner is mounted thereon to permit easy control of cooking stations. The gas burner is connected to a gas line via a control valve. In a preferred configuration the control valve is mechanically connected to the burner whereby gas is selectively supplied to the burner when a utensil is placed on the burner. Conversely, gas is blocked from reaching the gas fired burner element when a utensil is not in place on the burner.

DESCRIPTION OF A PREFERRED EMBODIMENT

Figure 1:
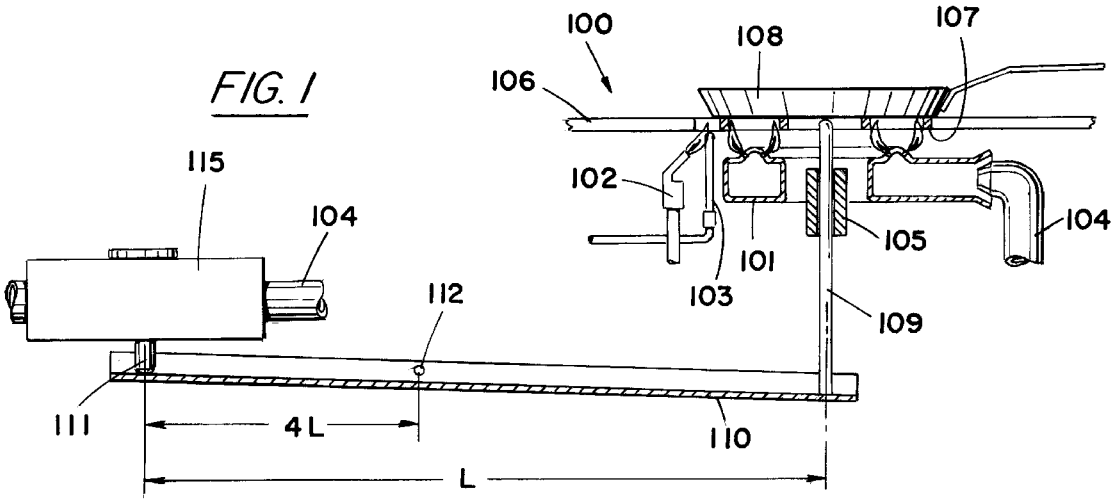
FIG. 1 is a partial cross-sectional elevation view of one embodiment of the automatic burner of the instant invention.

Referring now to FIG. 1, there is shown a partial cross-sectional view of one embodiment of the automatic ignition cooking range 100 of the instant invention. In this embodiment, the range 100 includes at least one cooking station. Of course, the range can have any number of cooking stations desired.

In the embodiment shown in FIG. 1, the range includes a gas burner ring 101 of conventional configuration along with a pilot light 102. A thermocouple 103 is located in juxtaposition to the pilot light 102. The thermocouple 103 detects the presence of a flame at the pilot light 102.

The burner ring 101 is connected to the gas line 104 (typically an iron pipe) in a conventional manner. The burner ring 101 is mounted in any convenient fashion in a cooking range which is represented by the surface 106 which includes a conventional grate 107. In FIG. 1, the grate 107 supports a cooking utensil such as is illustrated by pan 108 during the cooking process. That is, in the cooking process the pan 108 is placed on the grate 107 to be heated by the flame from burner 101. The relative positioning of the grate 107, surface 106, burner 101 and pan 108 are determined to provide an appropriate cooking station.

A suitable guide 105, for example a cylindrical tube, is positioned at the center of the burner ring. The guide 105 may be attached to the ring 101 or separately supported by the range 100.

Also, in this embodiment, a vertical rod 109 passes freely through an opening in guide 105. The lower end of vertical rod 109 engages one end of the lever arm 110. The ends of rod 109 and arm 110 may be pivotally connected together, if desired. However, a loose, abutting engagement is preferred. The other end of lever arm 110 similarly engages the bottom end of plunger 111 within valve 115 (described infra). In this embodiment, the arm 110 can be U-shaped (or L-shaped) to have a surface which bears against the lower end of the plunger 111 and the rod 109 while providing vertical surface to maintain the plunger and rod in proximity to the arm.

Valve 115 is a shut-off valve connected in the gas line 104 between the inlet or source of the gas line and the burner 101. Thus, when valve 115 is closed, gas does not flow through line 104 to burner 101. Conversely, when valve 115 is open, gas flows freely to burner 101 where it is ignited by the pilot light 102.

In this device, the valve 115 includes a plunger 111 which moves freely within the valve. The plunger 111 selectively opens and closes valve 115 relative to gas line 104.

The lever arm 110 is pivotally mounted to the range in any suitable fashion such as a pivot pin 112. Thus, the positions of rod 109 and plunger 111 adjacent the opposite ends of arm 110 are mutually interdependent upon each other.

It is noted that the position of pivot pin 112 can be determined by the relative lengths of travel of plunger 111 and rod 105. That is, the position of the pivot pin 112 determines the lengths of the arm portions between pivot pin 112 and respective ends of arm 110. The length of these arm portions controls the arc of movement of the respective ends of arm 110 and, thusly, the length of travel of the plunger 111 and the shaft 109, respectively. (Of course, the geometry of the system may be determined in the reverse procedure. That is, the required length of travel of the plunger 111 and the rod 109 may dictate the position of the pivot pin relative to arm 110.)

In any event, the plunger 111 is, typically, spring loaded to the closed position. Thus, the plunger must be overtly moved to the open position to permit gas flow through the valve. In this embodiment, plunger 111 must be forced upwards to open valve 115. To force plunger 111 upwards, arm 110 must be rotated clockwise around pivot pin 112. Arm 110 is rotated by causing rod 109 to push against the end of arm 110. Rod 109 is forced downwardly, through guide 105 when pan 108 is placed on the grate 107 in the cooking position. In other words, the rod 109 normally extends above the top surface of grate 107. This can be a result of the spring loaded plunger pushing down on the end of arm 110. In this position, valve 115 is closed and burner 101 is "OFF".

When the pan 108 is placed on the grate 107, rod 109 is pushed downwardly against arm 110 (as shown in FIG. 1). This action causes plunger 111 to be pushed upwardly by arm 110. When plunger 111 is pushed up, valve 115 is open and gas flows therethrough (and through gas line 104) to burner 101. When gas reaches burner 101, it is ignited by the flame of pilot light 102. Thus, heat is applied to pan 108.

Conversely, when pan 108 is removed from the grate 107, rod 109 is released whereupon the spring loaded plunger 111 is able to push arm 110 and, at the same time, to close valve 115. Thus, instant "ON" and instant "OFF" operation is achieved—without the need to operate the control knob on the range.

Figure 2:
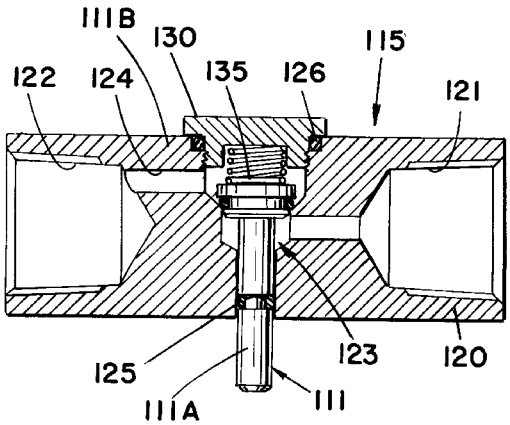
FIG. 2 is a cross-sectional view of one embodiment of the valve included in the invention.

Referring now to FIG. 2, there is shown an elevational, cross-sectional view of one embodiment of a valve 115 included in the instant invention. The valve includes body 120 which is fabricated of aluminum alloy, brass, or any other suitable material. The body 120 is, typically, rectilinear in shape for ease of handling and manufacture but is not so limited.

Openings 121 and 122 are provided at opposite ends of body 120. The openings 121 and 122 extend partway along the axial dimension of body 120. A depth of about ⅓ the length of the body 120 is considered reasonable. This arrangement preserves a substantial segment of the central portion of the body 120. The openings 121 and 122 can have any suitable diameter and, typically, include internal threads to receive gas pipe lines 104 (or any conventional fittings). A center bore 123 is formed radially through body 120 at about the midpoint thereof. In a preferred embodiment, bore 123 includes a plurality of different radial dimensions whereby a plurality of shoulders or ledges are formed in the sidewall of bore 123. This configuration can be achieved by counterboring the central bore as discussed infra and has the effect of forming a plurality of chambers in the center bore.

An inlet bore 124 is drilled through the central portion of the body 120 and communicates between input opening 122 and one chamber of bore 123. An outlet bore 127 is drilled through the central portion of body 120 and communicates between output opening 121 and another chamber of bore 123.

Plunger 111 includes an elongated shaft 111A which passes freely through the smallest diameter portion of bore 123. An O-ring 125 is seated in a groove in shaft 111A in order to form a leak-proof, but movable seal between plunger 111 and valve body 120.

Plunger 111 also includes an enlarged head 111B at one end thereof. An O-ring 126 is seated in a groove in the periphery of head 111B. O-ring 126 forms a leak-proof seal between plunger head 111B and another portion of valve body 120 defined by another portion of bore 123 between inlet bore 124 and outlet bore 127.

A threaded cap 130 is intended to threadedly engage an internally threaded portion of the largest end of bore 123. Cap 130 is, preferrably, formed of the same material as the body 120 and provides a leak-proof seal when cap 130 is in place.

A spring 131, typically a helical spring, is placed between cap 130 and plunger head 111B. A spring retention receptacle 132 can be formed in (or on) the inner surface of cap 130 to receive and retain spring 131. A similar spring retention device 135 can be formed on the surface of plunger head 111B.

The spring 131 is arranged to spring-load plunger 111 into the closed position as shown in FIG. 2. In this position, valve 115 is closed and prevents flow therethrough of any fluid (liquid or gas). Moreover, any fluid which enters the valve via input opening 122 traverses inlet bore 124 and is trapped in bore 123 between cap 130 and the O-ring 126 on plunger head 111B. This trapped fluid also adds some pressure to the plunger head 111B to maintain the plunger 111 in the closed position. (It will be noted that gas does not otherwise escape from bore 123 because O-ring 125 provides the leak-proof seal around plunger 111.) Thus, in the apparatus shown in FIG. 1, the burner 101 does not receive any of the fluid (gas) and remains OFF (in the absence of a cooking utensil on grate 107 to move plunger 111).

Conversely, when pan 108 is placed on the range 100, rod 109 is forced downwardly which, through lever arm 110, forces plunger 111 upward against the pressure supplied by spring 131 (and any trapped fluid). When plunger 111 moves upward, O-ring 126 is removed from its sealing position with body 120. Thus, gas is permitted to flow from input opening 122, through inlet bore 124, chamber 123, outlet bore 127, to outlet opening 121 and any conduit, such as pipe line 104, which is connected thereto. This permits gas to be supplied to burner 101 where the gas is ignited by pilot light 102 and activates the burner operation. Thus, the burner is activated by merely placing the pan on the burner.

Figure 3:
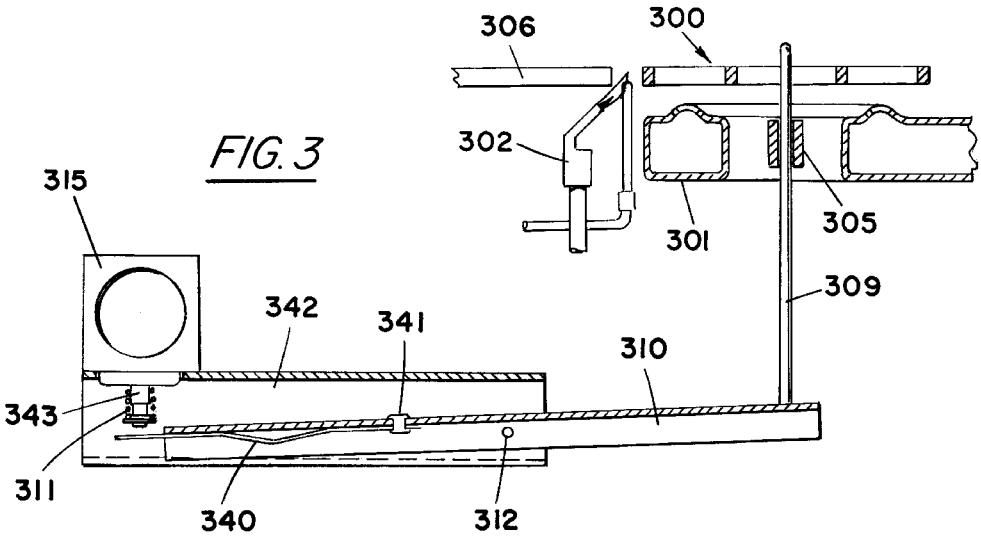
FIG. 3 is a partial cross-sectional view of another embodiment of the automatic burner of the instant invention.

Referring now to FIG. 3, there is shown a partial cross-sectional view of another embodiment of the automatic ignition cooking range 300. In this embodiment, the range 300 includes at least one cooking station. Of course, the range can have any number of cooking stations desired.

In the embodiment shown in FIG. 3, the range (which is similar to the embodiment shown in FIG. 1) includes a gas burner ring 301 of conventional configuration along with a pilot light 302. The burner ring 301 is connected to the gas line 304.

The burner ring 301 is mounted in any convenient fashion in a cooking range which is represented by the surface 306 which includes a conventional grate 307. In FIG. 3, the grate 307 does not support a cooking utensil (such as is illustrated by pan 108 in FIG. 1). However, such a utensil is utilized during the cooking process. That is, in the cooking process the pan is placed on the grate 307 to be heated by the flame from burner 301. A suitable guide 305 is positioned at the burner ring 301.

Again, in this embodiment, a vertical rod 309 passes freely through an opening in guide 305. The lower end of vertical rod 309 engages one end of the lever arm 310. The ends of rod 309 and arm 310 may be pivotally connected together, if desired. However, a loose, abutting engagement is shown.

The other end of lever arm 310 includes an adjustable leaf spring 340 which is attached to arm 311 by a rivet 341 or similar fastener. The leaf spring 340 extends beyond the end of arm 310 and engages the bottom end of plunger 311 within, valve 315 (described infra). In this case, the arm 310 can have an inverted U-shape or an inverted L-shape configuration. The leaf spring is affixed to the lower surface of the horizontal portion of the arm.

Valve 315 is a shut-off valve connected in the gas line 304 between the inlet or source of the gas line and the burner 301. Thus, when valve 315 is closed, gas does not flow through line 304 to burner 301. Conversely, when valve 315 is open, gas flows freely to burner 301 where it is ignited by the pilot light 302. Valve 315 is mounted on a bracket 342 in the cooking range. The bracket is generally inverted U-shaped in configuration. A lever arm 310 is mounted in the bracket 342 by pivot pin 312.

In this device, the valve 315 includes a plunger 311 which moves freely within the valve. The plunger 311 selectively opens and closes valve 315 relative to gas line 304.

The lever arm 310 (as was the case with lever arm 110) is pivotally mounted to the range in any suitable fashion such as a pivot pin 312. Thus, the position of rod 309 and plunger 311 adjacent the opposite ends of arm 311 are mutually interdependent upon each other. As noted relative to the embodiment shown in FIG. 1, the position of the pivot pin 312 determines the lengths of the arm portions on each side of the pivot pin 312. The length of these arm portions controls the arc of movement of the respective ends of arm 310 and, thusly, the length of travel of the plunger 311 and the shaft 309, respectively (or vice versa). That is, the required length of travel of the plunger and the rod may dictate the position of the pivot pin 312 relative to arm 310.)

In any event, the plunger 311 is, typically, spring loaded to the closed position. Thus, the plunger must be overtly moved to the open position to permit gas flow through the valve. In this embodiment, plunger 311 must be forced upwards to open valve 315. To force plunger 311 upwards, arm 310 must be rotated clockwise around pivot pin 312. Arm 310 is rotated by causing rod 309 to push against the end of arm 310. Rod 309 is forced downwardly, through guide 305 when a pan (such as pan 108 shown in FIG. 1) is placed on the grate 307 in the cooking position. Inasmuch as rod 309 normally extends above the top surface of grate 307, when a pan (such as pan 108 shown in FIG. 1) is placed on the grate 307, rod 309 is pushed downwardly against arm 310. This action causes plunger 311 to be pushed upwardly by arm 310 and leaf spring 340. When plunger 311 is pushed up, valve 315 is opened and gas flows therethrough (and through gas line 304) to burner 301. Then gas reaches burner 301, it is ignited by the flame of pilot light 302. Thus, heat is applied to the pan (or similar utensil).

When a pan is not in place on the grate 307, rod 309 is released whereupon the spring loaded plunger 111 is able to push arm 310 and move to close valve 315. Thus, instant "ON" and instant "OFF" operation is achieved—without the need to operate the control knob on the range.

Figure 4:
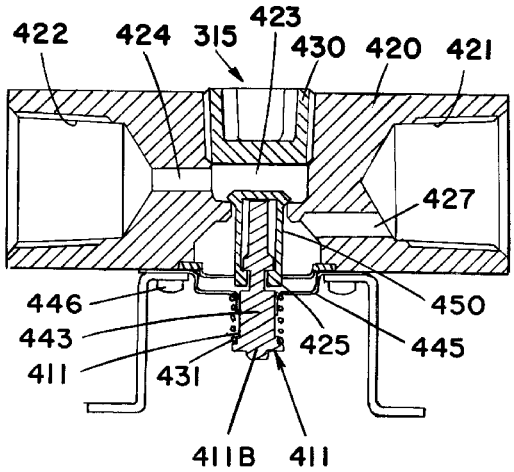
FIG. 4 is a cross-section view of another embodiment of the valve included in the invention.

Referring now to FIG. 4, there is shown an elevational, cross-sectional view of one embodiment of a valve 415 included in the instant invention. In FIG. 4, valve 315 is rotated 90° from the position shown in FIG. 3. The valve includes body 420 which is fabricated of cast iron, brass, or any other suitable material. The body 420 is, typically, rectilinear in shape for ease of handling and manufacture but is not so limited.

Openings 421 and 422 are provided at opposite ends of body 420. The openings 421 and 422 extend partway along the axial dimension of body 420. A central portion of the body 420 is preserved. The openings can include internal threads to receive gas pipe lines 104 (or any conventional fittings). A center bore 423 is formed through body 420 at about the mid-point thereof. In a preferred embodiment, bore 423 includes a plurality of different radial dimensions whereby a plurality of shoulders or ledges are formed in the sidewalls of bore 423. This configuration can be achieved by counterboring the central bore 423 from opposite sides of the valve body and forms a plurality of chambers in the center bore.

An inlet bore 424 is drilled through the central portion of the body 420 and communicates between input opening 422 and one chamber of bore 423. An outlet bore 427 is drilled through the central portion of body 420 and communicates between output opening 421 and another chamber of bore 423.

Plunger 411 includes an elongated shaft 443 which passes freely through a nipple 343 in cover 445, which can be formed of drawn metal or the like. The cover 445 can be affixed to body 420 along with bracket 412 by screws 446.

A unitary diaphragm valve seat 450 is placed over the interior end of plunger 411. The diaphragm portion is sandwiched between cover 445 and body 420 to cover bore 423. The end 425 of valve seat 450 is seated in a groove in shaft 443 in order to form a leak-proof, but movable seal with plunger 411.

The other end of valve seat 450 forms a leak-proof seal between the chambers of bore 423 when plunger 411 is disposed between inlet bore 424 and outlet bore 427 in the bore 423.

A threaded cap 430 engages an internally threaded portion of the other end of bore 423. Cap 430 is, preferrably, formed of the same material as the body 420 and provides a leak-proof seal when in place.

A spring 431, typically a helical spring, is placed between cover 445 and plunger head 411B.

The spring 431 is arranged to spring-load plunger 411 into the closed position as shown in FIG. 4. In this position, valve 315 is closed and prevents fluid flow therethrough. Moreover, any fluid which enters the valve via input opening 422 traverses inlet bore 424 and is trapped in bore 423 between cap 430 and the end of valve seat 450 on the interior end of plunger head 411. This trapped fluid also adds some pressure to maintain the plunger 411 in the closed position. Thus, in the apparatus shown in FIG. 3, the burner 301 does not receive any of the fluid (gas) and remains OFF (in the absence of a cooking utensil on rod 309).

Conversely, when a pan is placed on the range 300 in FIG. 3, it forces the rod 309 down which, through lever arm 310, forces plunger 411 (refer now to FIG. 4) upward against the pressure supplied by spring 431 (and any trapped fluid). When plunger 411 moves upward, valve seat 450 is removed from its sealing position with body 420. Thus, gas is permitted to flow from input opening 422, through inlet bore 424, chamber 423, outlet bore 427, to outlet opening 421 and any conduit, such as pipeline 104 which is connected thereto. This permits gas to be supplied to burner 101 where the gas is ignited by pilot light 102 and activates the burner operation. Thus, the burner is activated by placing a pan on the burner.

It will be noted that gas does not otherwise escape from bore 423 because valve seat diaphragm 425 provides the leak-proof seal around plunger 411.

Figure 5:
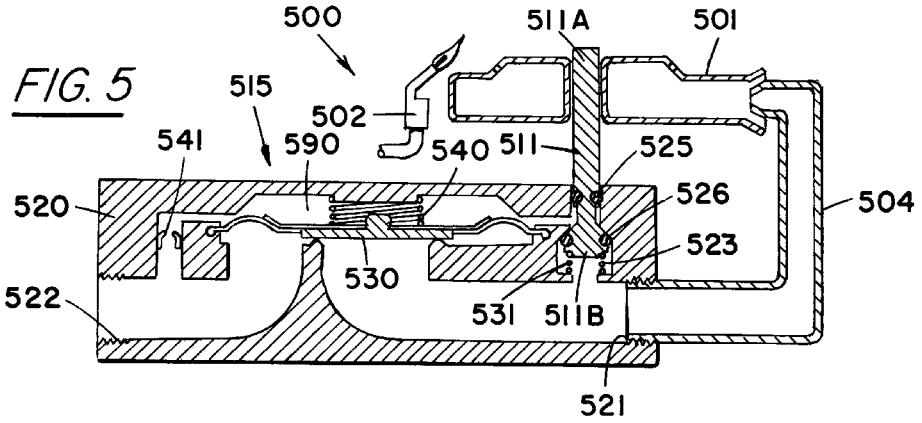
FIG. 5 is a cross-sectional elevation view of another embodiment of the automatic burner of the instant invention in the "OFF" condition.
Figure 6:
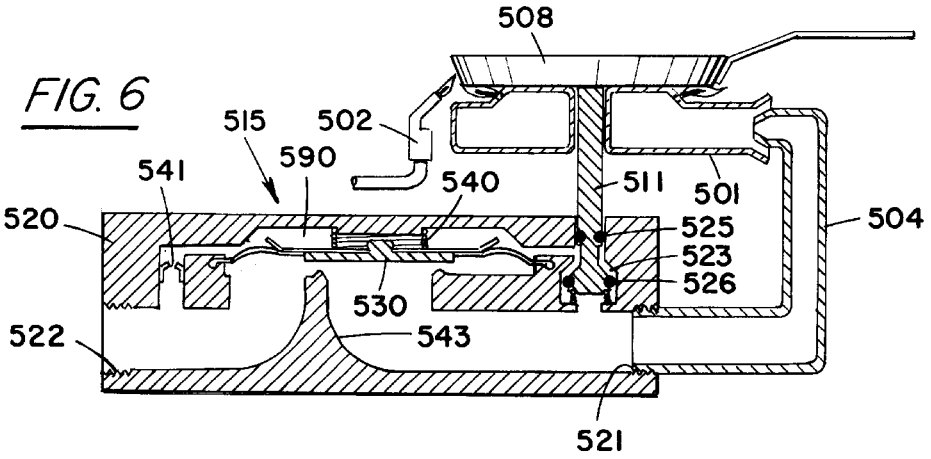
FIG. 6 is a cross-sectional elevaton view of the embodiment of the instant invention shown in FIG. 4 in the "ON" condition.

Referring now to FIGS. 5 and 6, there is shown another embodiment of the instant invention. In this embodiment, the lever arm, per se, is omitted while the plunger and valve are formed as a unitary component. Nevertheless, components which are similar to components depicted in other Figures are identified by reference numerals with similar last numbers. For example, the gas line 504 in FIGS. 5 and 6 is similar to the gas line 104 in FIGS. 1 and 3.

Referring now to FIG. 5, there is shown an embodiment of the instant invention in the OFF or standby status. That is, the plunger 511 extends above the upper surface of burner 501 inasmuch as there is no cooking utensil on the burner.

With the plunger 511 in the upward position, the O-rings 525 and 526 seat against the inner surface of bore 523. O-ring 525 prevents leakage between the plunger 511 and the body 520. Likewise, O-ring 526 prevents the gas from passing between the enlarged plunger head 511B and the walls of bore 523 into the plenum 590 behind the diaphragm 530 which is spring loaded downwardly. Thus, there is a pressure equilibrium on both sides of the diaphragm created by the gas which is applied to both of the surfaces of the diaphragm. That is, gas enters the input opening 522 of valve 515 and bears on the under surface of diaphragm 530 which is, however, spring loaded in the closed position (as shown) by the spring 540. In addition, gas flows through the orifice 541 into the plenum above the diaphragm. The equal pressures do not produce movement of the diaphragm against the spring 540.

Referring now to FIG. 6, there is shown the valve 515 in the ON or cooking status. That is, pan 508 has been placed on the burner 501 and forced plunger 511 downwardly. Thus, the seal created by O-ring 526 is broken whereupon the gas in the plenum 590 above the diaphragm can escape through bore 523. The pressure differential within valve 515 is now sufficient that the input gas causes diaphragm 520 to move upwardly. With this movement, the diaphragm is displaced from the central body portion 543 and permits communication between the input and output openings in the valve. This free flow of gas is applied to burner 501 via gas line 504. The gas at burner 501 is ignited by pilot light 502 whereupon the system is in the operative or cooking status.

Figure 7:
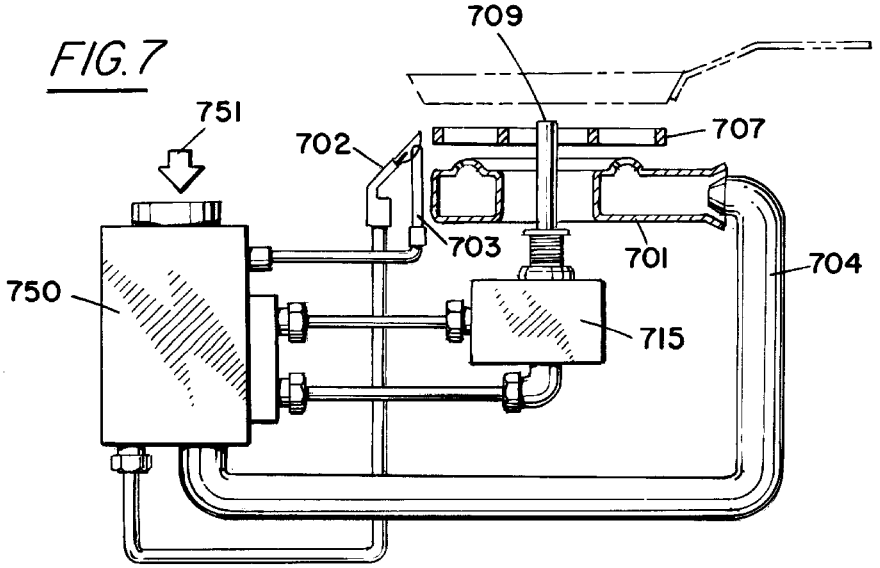
FIG. 7 is a schematic representation of burner control system in accordance with the instant invention.

Referring now to FIG. 7, there is shown a schematic representation of a burner control system in accordance with the instant invention.

In this view, the thermocouple 703 is mounted adjacent to the pilot 702 and the burner ring 701, as described supra. The plunger 709 passes through the burner ring 701 and the grate 707. The plunger 709 is movably mounted in the control valve 715, as described supra. The inlet and outlet coupling lines are joined to valve 715. The burner gas supply line 704 is connected between the gas valve 750 and the burner ring to selectively supply gas from the control valve 715 to the burner ring. The gas valve 750 also supplies gas to the pilot 702. The gas valve 750 is connected to the gas main in the conventional fashion, as suggested by the arrow 751.

The gas valve 750, typically, includes a thermostatic control unit, for example, a bimetallic, or electromagnetic control unit which is connected to the thermocouple 702. Thus, if the pilot light 702 is active, i.e. applying heat to the thermocouple 703 because the pilot light is "on", the gas valve 750 is closed and allows gas to pass through the control valve 715. In this case, the thermocouple 703 provides a small voltage signal to a magnet or the like in gas valve 750. In this case, valve 715 is selectively operative to control the flow of gas to burner ring 701 as a function of the placement of a utensil on the burner ring 701 and the plunger 709 in the manner described supra.

Conversely, then the thermocouple is activated by heat from a flame at the pilot 702, gas valve 750 is open to permit gas flow to control valve 715 whereupon the burner remains inoperative irrespective of the placement of a utensil thereon or not.

Thus, there is shown and described a unique design and concept of cooking range with automatic gas burner ignition. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A burner control comprising, an armature movably mounted adjacent to a burner ring, and a valve connected in the supply line associated with said burner ring, said valve including an inlet, an outlet and blocking means mounted in said valve to selectively prevent communication between said inlet and said outlet in said valve, said armature means operative to selectively move said blocking means to control the position thereof, said armature means includes first plunger means mounted at said burner ring, second plunger means mounted in said valve in engagement with said blocking means, and intermediate means for selectively positioning said second plunger means within said valve as a function of said first plunger means relative to said burner ring.

2. The burner control recited in claim 1 wherein, said intermediate means comprises a pivotally mounted lever arm having the opposite ends thereof disposed adjacent to said first and second plunger means, respectively.

3. The burner control recited in claim 2 wherein, said lever arm is U-shaped to bear against and retain the lower end of at least one of said first and second plunger means.

4. The burner control recited in claim 2 including, leaf spring means disposed at one end of said lever arm adjacent to said second plunger means.

5. The burner control recited in claim 1 wherein, said outlet is adapted to be connected to the burner ring via conduit means.

6. The burner control recited in claim 1 including, guide means mounted adjacent to said burner ring to control the position of said first plunger means.

7. The burner control recited in claim 1 wherein, said blocking means includes a leakproof seal disposed on said second plunger means.

8. The burner control recited in claim 1 wherein, said inlet and said outlet include openings in said valve, said openings include bores with different radial dimensions to thereby define a plurality of chambers in said valve, said chambers defined by a plurality of shoulders within said valve which selectively engage said blocking means.

9. The burner control recited in claim 1 including, diaphragm valve seat means disposed at the interior end of said second plunger means.

10. A burner control apparatus comprising, an appliance gas ring, a gas supply control valve connected between a gas source and said gas ring, plunger means mounted adjacent to said gas ring and adapted to be selectively moved relative to said gas ring by the placement of a utensil on said gas ring, and mechanical connection means connecting said plunger means to said control valve to selectively permit said control valve to permit gas to flow from said gas source to said gas ring, said mechanical connection means includes armature means within said control valve, said control valve includes inlet and outlet ports which are in selective communication as a function of the position of said armature which is controlled by the operation of said mechanical connection means.

11. The apparatus recited in claim 10 wherein, said armature means includes a spring loaded diaphragm within said control valve.

12. The apparatus recited in claim 10 wherein, said mechanical connection means includes second plunger means in said control valve.

13. A burner control comprising, a rod adapted to be movably mounted adjacent to a gas burner ring, a valve connected in the supply line associated with the gas burner ring, said valve including an inlet port and an outlet port, blocking means including spring-loaded diaphragm means mounted in said valve and selectively preventing communication between said inlet port and said outlet port, a plenum formed in said valve behind said diaphragm means, said plenum communicating with said inlet port wherein pressure equalization is achieved on opposite sides of said diaphragm means and communication between said inlet port and said outlet port is prevented when said rod is in a first position, said plenum selectively communicating with said outlet port when said rod is in a second position wherein the pressure equalization is removed so that said diaphragm is moved and communication is permitted between said inlet port and said outlet port in said valve.

14. The burner control recited in claim 13 wherein, said diaphragm is displaceably mounted within said valve.

15. The burner control recited in claim 13 including, orifice means communicating between said inlet port and said plenum.

* * * * *